US009574570B2

(12) United States Patent
Lillis

(10) Patent No.: US 9,574,570 B2
(45) Date of Patent: Feb. 21, 2017

(54) SHAFT SPEED AND VIBRATION SENSOR APPARATUS

(75) Inventor: Mark Lillis, South Windsor, CT (US)

(73) Assignee: Hamilton Sundstard Corporation, Windsor Locks, CT (US)

( * ) Notice: Subject to any disclaimer, the term of this patent is extended or adjusted under 35 U.S.C. 154(b) by 1767 days.

(21) Appl. No.: 12/938,970

(22) Filed: Nov. 3, 2010

(65) Prior Publication Data

US 2012/0107094 A1 May 3, 2012

(51) Int. Cl.
*F04D 29/00* (2006.01)
*F04D 27/00* (2006.01)
*F01D 17/06* (2006.01)

(52) U.S. Cl.
CPC ..... *F04D 27/001* (2013.01); *F01D 17/06* (2013.01); *F05D 2270/334* (2013.01)

(58) Field of Classification Search
CPC ..... F01D 17/06; F04D 27/001
USPC .... 415/16, 21, 30, 35, 118, 119; 416/43, 61, 416/71, 500
See application file for complete search history.

(56) References Cited

U.S. PATENT DOCUMENTS 3,488,581 A 1/1970 Foster
4,835,505 A 5/1989 Hattori et al.
4,905,507 A * 3/1990 Klein et al. ..... 73/115.08
5,310,311 A 5/1994 Andres et al.
5,551,291 A 9/1996 Morita
5,572,119 A 11/1996 Taylor
5,921,683 A 7/1999 Merritt et al.
6,058,715 A 5/2000 Strang et al.
6,124,646 A 9/2000 Artinian et al.
6,151,909 A 11/2000 Carter et al.
6,257,003 B1 7/2001 Hipsky
6,283,410 B1 9/2001 Thompson
6,445,995 B1 9/2002 Mollmann
6,615,606 B2 9/2003 Zywiak
6,640,451 B1 * 11/2003 Vinarcik ..... 33/1 PT
6,942,183 B2 9/2005 Zywiak
6,966,198 B2 11/2005 Piccirilli et al.
6,969,986 B2 * 11/2005 Schmid et al. ..... 324/166
(Continued)

FOREIGN PATENT DOCUMENTS

EP 0137270 A2 4/1985
EP 0631139 A1 12/1994
(Continued)

OTHER PUBLICATIONS

FR 2930037A1 translation provided by Espacenet.*
(Continued)

*Primary Examiner* — Dwayne J White
*Assistant Examiner* — Justin Seabe
(74) *Attorney, Agent, or Firm* — Kinney & Lange, P.A.

(57) ABSTRACT

A rotary apparatus comprises a shaft having a rotational axis, a rotation indicator formed on the shaft, a target feature proximate the rotation indicator, and a sensor proximate the target feature. The target feature extends circumferentially about the shaft, with a radial face transverse to the rotational axis and a circumferential face along the rotational axis. The sensor is oriented toward the rotation indicator to sense a rotational speed of the shaft, and oriented toward the target feature to sense transverse vibrations based on a radial distance to the target feature and longitudinal vibrations based on an axial distance to the target feature.

16 Claims, 4 Drawing Sheets

(56) References Cited

U.S. PATENT DOCUMENTS

| | | | | |
|---|---|---|---|---|
| 7,285,949 | B2 | 10/2007 | Burns et al. | |
| 7,779,644 | B2 | 8/2010 | Decrisantis et al. | |
| 2007/0079613 | A1 | 4/2007 | Greentree | |
| 2007/0268014 | A1* | 11/2007 | Shimomura et al. .... | 324/207.16 |
| 2009/0238683 | A1* | 9/2009 | Alvanos et al. ..... | 415/173.7 |

FOREIGN PATENT DOCUMENTS

| | | | |
|---|---|---|---|
| FR | 2930037 | A1 * | 10/2009 |
| JP | 2004132821 | A | 4/2004 |

OTHER PUBLICATIONS

European Search Report in counterpart European Application No. 11189809.4 filed Nov. 18, 2011.
Extended European Search Report from EP Application Serial No. 15150262.2, Dated Apr. 9, 2015, 9 pages.

* cited by examiner

SHAFT SPEED AND VIBRATION SENSOR APPARATUS

BACKGROUND

This invention relates generally to rotary machines, and specifically to turbomachinery. In particular, the invention concerns a shaft speed and vibration sensor apparatus suitable for use with a turbine engine, for example an air cycle machine (ACM).

Turbine engines include turbines, compressors, fans, gas turbines and turbine generators, as well as turbojet, turbofan, turboprop and turboshaft engines for aviation applications. Air cycle machines are a class of turbine engines using a compressor and an expansion turbine to provide refrigeration and cooling by processing a compressible working fluid, usually air. In aviation applications, compressed air is supplied by the bleed system, an auxiliary power unit (APU), or a dedicated compressed air supply.

Air cycle machines are open-cycle systems, in which the working fluid itself is used for primary cooling and ventilation. This contrasts with closed-cycle refrigeration systems, which perform repeated evaporation/condensation cycling of a separate (primary) refrigerant, and then use the primary refrigerant to cool an airflow or water flow, or a process fluid stream.

In aviation applications, the environmental control system (ECS) typically uses one or more air cycle machines to regulate air temperature and pressure in the cabin, cockpit and cargo bay. Each ACM includes a compressor and an expansion turbine, combined with two or more heat exchangers to make up an air conditioning unit or A/C pack. The AC packs cool compressed air in the first heat exchanger, reheat the air in the compressor, then cool the air again in the second heat exchanger before allowing it to expand in the turbine.

The overall pressure ratio from the compressor inlet to the turbine outlet is less than one, so there is sufficient energy in the compressed air supply to drive the ACM compressor via the expansion turbine. Thermal energy is also given up in the heat exchangers, resulting in a cold, relatively low-pressure airflow from the turbine outlet. This flow is mixed with additional (hot) air from the compressed air supply, allowing the environmental control system to regulate internal pressures and temperatures.

To ensure proper operation, the ACM shaft speed must be monitored in order to regulate the compression ratio and exit flow temperature. Over time, air cycle machines and other turbomachinery may also experience vibrations and wobble resulting from bearing damage or shaft deformation, and due to wear and tear on the various rotary components.

SUMMARY

This invention concerns a rotary apparatus. The apparatus includes a shaft with a rotation indicator and a target feature extending circumferentially about the shaft, proximate the rotation indicator. The target feature has a radial face that extends along the shaft radius, transverse to the rotational axis, and a circumferential face that extends along the rotational axis, transverse to the radius.

A shaft speed and vibration sensor is positioned proximate the target feature, and oriented toward the rotation indicator to sense rotational speed. The sensor is also oriented toward the target feature, in order to sense transverse and radial vibrations of the shaft based on radial and axial distances from the target feature to the sensor.

DETAILED DESCRIPTION

Figure 1:
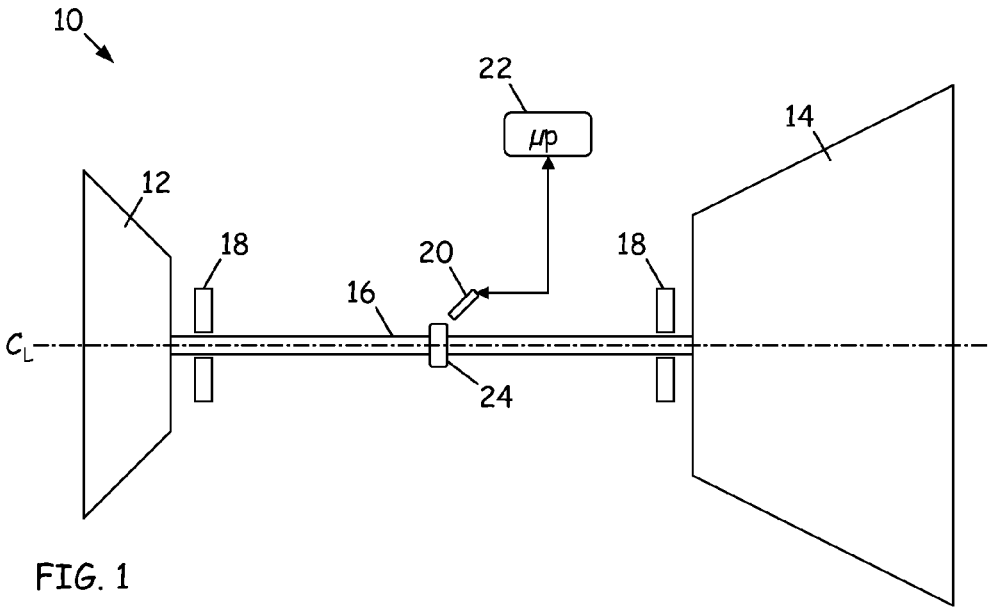
FIG. 1 is a schematic view of a turbomachine.

FIG. 1 is a schematic view of turbine apparatus (or turbomachine) 10 comprising turbine 12, compressor 14 and shaft 16 with bearings 18. Turbine 12 and compressor 14 are rotationally mounted to shaft 16, which is supported by bearings 18. Sensor 20 is oriented proximate shaft 16, with processor/controller 22 configured to monitor the rotational speed and vibrational characteristics of turbomachine 10 using signals generated by sensor 20. The signals are based on the axial, radial and rotational position of target feature 24.

In the two-wheel bootstrap embodiment of FIG. 1, turbine 12 and compressor 14 are mounted on a common turbine shaft 16. In this configuration, turbine 12 typically comprises an expansion turbine and compressor 14 comprises a radial compressor, with turbine 12 driving compressor 14 by expansion as described above. Alternatively, compressor 14 comprises an axial flow compressor or fan and turbomachine 10 comprises a simple air cycle machine. In each of these embodiments, shaft 16 directly connects turbine 12 to compressor 14, without intervening gears or gearing mechanisms, such that turbine 12 and compressor 14 co-rotate at the same speed about turbine axis $C_L$.

A number of bearings 18 are configured for a combination of axial and radial loading to support shaft 16, turbine 12 and compressor 14 in rotation about turbine axis $C_L$. In one embodiment, bearings 18 comprise air bearings. In other embodiments, bearings 18 comprise magnetic bearings, roller bearings, ball bearings, journal bearings or thrust bearings, or a combination thereof.

In each of these respects, the particular representation of FIG. 1 is merely representative. In other embodiments, for example, compressor 14 comprises any of a fan, axial flow compressor, radial compressor, or axial/radial compressor, and turbomachine 10 comprises any of a two-wheel machine with a single turbine 12 and compressor 14, a three-wheel machine with two or more compressors or fans 14, or a four-wheel/dual spool machine with two coaxial shafts 16 and two independent turbines 12, each driving independent compressor or fan spools. In some of these embodiments, turbomachine 10 comprises a gas turbine or rotary internal combustion turbine engine, and operates on any combination of compressed air, water vapor, fuel vapor, and combustion gas, or other working fluid.

Figure 2A:
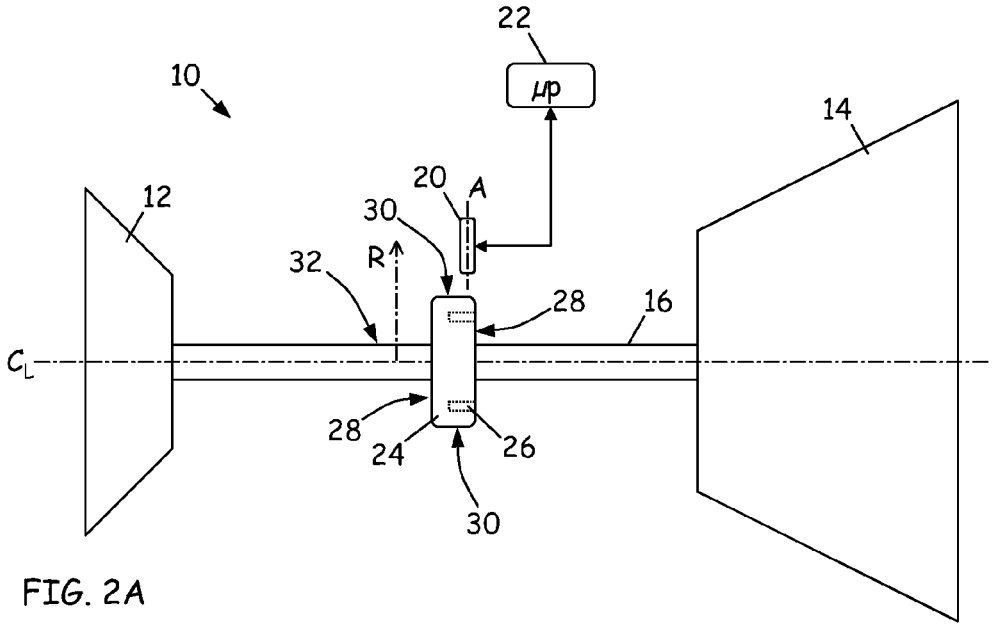
FIG. 2A is a schematic view of the turbomachine with a transverse shaft speed and vibration sensor.

FIG. 2A is a schematic view of turbomachine 10 with shaft speed and vibration sensor 20 in a transverse or perpendicular orientation with respect to shaft 16. Turbine 12 and compressor 14 are coupled to shaft 16 about turbine axis $C_L$, with turbine 12 driving compressor 14.

Sensor 20 is positioned proximate shaft 16 and oriented toward target feature 24 and rotational indicator (or indicia) 26, in order to sense rotational and vibrational motions of shaft 16. Depending on embodiment, sensor 20 may comprise a magnetic speed sensor such as a variable reluctance sensor. In these embodiments, rotational indica 26 are typically formed of magnetic material, for example a ferrous or ferrogmagnetic material. Alternatively, sensor 20 is an inductive or electromagnetic device such as an eddy current probe, and rotational indicia 26 comprise a conducting material such as a metal or metal alloy.

Axis A of sensor 20 is oriented toward indicia 26 in order to sense the rotational speed of shaft 16. Sensor 20 also measures longitudinal vibrations of shaft 16 based on the axial distance from target feature 24 to sensor 20 (e.g., from radial face 28), and sensor 20 measures transverse vibrations of shaft 16 based on the radial distance from target feature 24 to sensor 20 (e.g., from circumferential face 30).

The configuration of apparatus 10 distinguishes from systems that utilize a number of different sensor elements for rotational speed and vibrational measurements, and from systems that use different vibrational sensors for transverse and longitudinal directions. Sensor 20, in contrast, is a unitary sensor element, where the same sensor (or probe) 20 functions for both speed and vibration measurements, and where the same sensor (or probe) 20 senses vibrations along two independent longitudinal and transverse directions. Processor/controller 22 is used to decouple the various rotational and vibrational signals from sensor 20, as described below.

Target feature 24 extends circumferentially about shaft 16, with radial and circumferential faces 28 and 30 forming a figure of rotation about turbine axis $C_L$. Radial faces (or surfaces) 28 extend along or generally parallel to radius R, transverse to turbine axis $C_L$. Circumferential face (or surface) 30 extends along turbine axis $C_L$, transversely or generally perpendicular to radius R.

In the particular embodiment of FIG. 2A, target 24 is formed as a protruding feature, extending outward from shaft 16 and away from turbine axis $C_L$. In this embodiment, radial or end faces 28 extend radially outward from major surface 32 of shaft 16. Circumferential face 30 extends along turbine axis $C_L$, radially outward of major surface 32. Alternatively, target 24 is a recessed feature (see, e.g., FIGS. 4B and 4C), with end faces 28 and circumferential face 30 extending radially inward of major surface 32.

Target feature 24 typically has greater radial extent (height or depth) along radial faces 28 than do rotational indicia 26 (described below), for example at least two or three time as great, such that circumferential face 30 is positioned proximate sensor 20. Depending on embodiment, the radial height or depth of target feature 24 is typically at least ten percent of the radius of turbine axis 16, or as great as thirty percent or more. For protruding target features 24, the feature height may exceed fifty percent of the radius of turbine axis 16, or be as great as the radius of turbine axis 16. Alternatively, target feature 24 extends outward up to two or three times the radius of turbine axis 16, or more than two or three times the radius of turbine axis 16.

Indicia 26 are formed by drilling, cutting or machining shaft 16 proximate target feature 24, for example in circumferential face 30 of target feature 24, or in major surface 32 of shaft 16. In some embodiments, rotational indicia 26 are formed in radial face 28 of target feature 24, or in both radial face 28 and circumferential face 30. Alternatively, indicia 26 are formed as buttons, datum structures, tabs, protuberances or other radial extensions, on either or both faces 28 and 30 of target feature 24, or on major surface 32 of shaft 16.

As shown in FIG. 2A, rotational indicia 26 are spaced circumferentially about turbine axis $C_L$ on shaft 16. As shaft 16 rotates, indicia 26 pass sensor 20 and the probe signal transitions from high to low (or low to high, depending on configuration) and back again. The rotational speed is determined by the number these "zero-crossing" detections in a given time interval, divided by the number of indicia 26.

In order to avoid aliasing, the sampling rate is generally higher than the rotational speed. In embodiments having three indicia 26, for example, the sampling rate is typically at least six times the rotational speed, such that the sampling frequency exceeds the Nyquist frequency (that is, twice the maximum signal frequency).

In some embodiments, indicia 26 are uniform in dimension and evenly spaced about turbine axis $C_L$, and the zero crossing signals are substantially regular. In other embodiments, one or more indicia 26 are nonuniform in spacing, or in radial or axial size, allowing individual indicia 26 to be distinguished by the corresponding signals in sensor 20.

In addition to rotational speed signals, sensor 20 is also sensitive to vibrations of shaft 16 based on the axial and radial motion of sensor target 24. The vibrational sensitivity extends over at least the same frequency range as the rotational signal, as defined by the sampling rate and rotational frequency.

In supercritical rotation, the rotational frequency of shaft 16 is generally higher than (at least) the fundamental mode or first critical frequency. The sampling rate is thus at least a few or several times the rotational frequency, based on the number of rotational indicia. This reduces aliasing, at least until higher order modes are excited. Active bearing control systems can also drive vibrations at a range of different frequencies, independent of the normal mode spectrum.

For systems using conventional ball or roller bearings, there is little wobble even when turbomachine 10 is subject to a certain level of rotor imbalance, because the mechanical bearings hold shaft 16 firmly in place. The same is true of well-controlled air and magnetic bearings, where there is little play. In actual practice, however, mechanical bearings experience wear over time, and both air and magnetic bearings can function as substantially frictionless systems even when some imbalance exists. Thus a certain degree of wobble or vibration is expected, and considered normal. Sensor 20 and processor controller 22 are configured to evaluate and monitor these vibration modes, in order to detect damage to shaft 16 and schedule preventative maintenance of turbomachine 10.

For radial or transverse vibrations, sensor 20 exhibits a characteristic sinusoidal signal which is superposed on the zero-crossing signal. The sinusoidal signal varies at the wobble or oscillation mode frequency, following the radial motion of shaft 16 in the gap between target feature 24 and sensor 20. Sensor 20 is also sensitive to longitudinal oscillations, as expressed in the axial motion of target feature 24 along turbine axis $C_L$. The longitudinal modes are also superposed on the zero-crossing signal, along with the transverse modes.

Processor/controller 22 decomposes the vibrational and rotational information from a (single) series of sensor signals, or signal profile. Depending on application, axial and radial vibrations of different amplitudes and frequencies are usually observed simultaneously, and the relevant modes are decoupled using a mode locking amplifier, or via frequency analysis methods such as a Fourier transform or FFT (fast Fourier transform). Processor/controller 22 also sets control parameters for sensor 20, including sampling rate, sensitivity parameters, and signal filtering variables.

Relative sensitivity to the different transverse and longitudinal modes depends on the orientation of sensor 20 with respect to target feature 24. In particular, sensitivity depends on the orientation of sensor axis A with respect to radial and circumferential faces 28 and 30. To increase sensitivity over a range of mode frequencies, sensor 20 is positionable in a variety of locations and orientations with respect to shaft 16 and target feature 24.

In FIG. 2A, sensor 20 has a transverse orientation, with axis A aligned within five or ten degrees of radius R; that is, generally perpendicular to shaft 16 and turbine axis $C_L$, and generally parallel to radius R. In this configuration, sensor 20 is oriented substantially toward radial face 28 of target feature 24, with increased sensitivity to radial motions and transverse vibration.

Figure 2B:
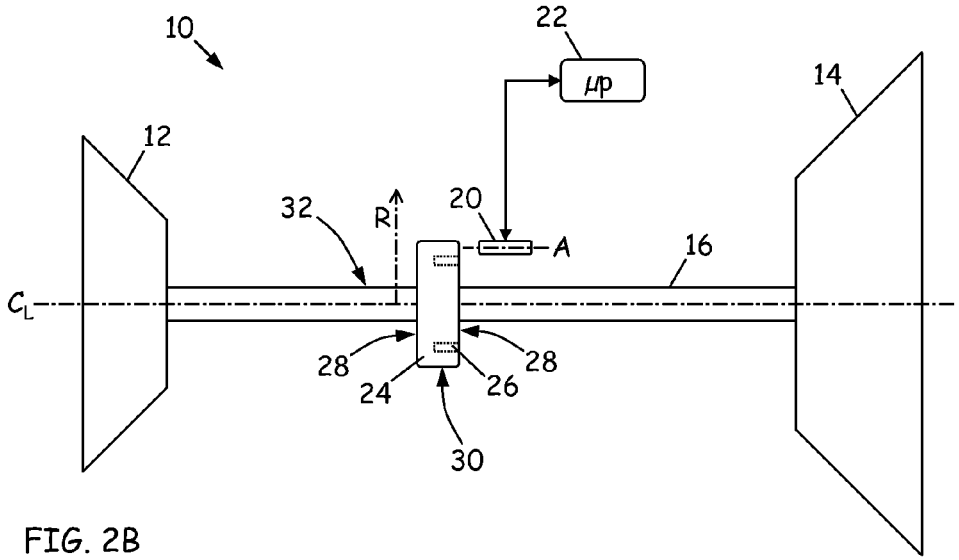
FIG. 2B is a schematic view of the turbomachine with a longitudinal sensor.

FIG. 2B is a schematic view of turbomachine 10, with sensor 20 in a longitudinal orientation. In this configuration sensor 20 is oriented with axis A along or generally parallel to turbine shaft 16, within five or ten degrees of turbine axis $C_L$. Sensor 20 is thus oriented toward radial face 28 of target feature 24, increasing sensitivity to axial motion and longitudinal vibration.

Figure 2C:
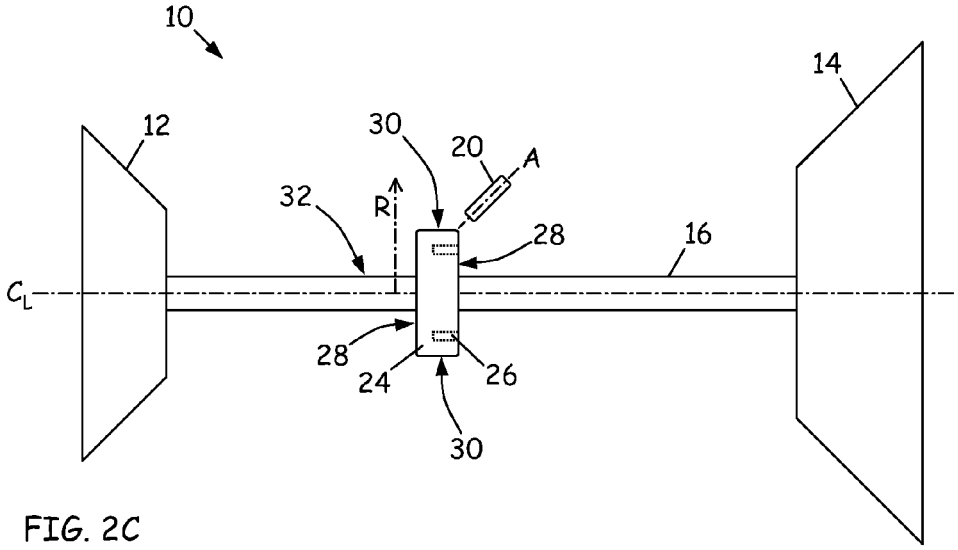
FIG. 2C is a schematic view of the turbomachine with a skew sensor.

FIG. 2C is a schematic view of turbomachine 10, with sensor 20 in a skew orientation. In this embodiment, sensor 20 is positioned with axis A at a skew angle with respect to turbine shaft 16, for example more than five or ten degrees from turbine axis $C_L$, and more than five or ten degrees from perpendicular radius R. Equivalently, sensor axis A is less than eighty or eighty-five degrees from perpendicular radius R, and from turbine axis $C_L$. In some embodiments, the skew angle is between thirty and sixty degrees, for example between about forty and fifty degrees, for example with sensor axis A oriented at about forty-five degrees to both turbine axis $C_L$ and perpendicular radius R.

In skew configurations, sensor 20 is simultaneously oriented toward radial face 28 and circumferential face 30 of target feature 24, increasing sensitivity to a combination of axial and radial motions. In particular, skew sensor configurations increase sensitivity to simultaneous transverse and longitudinal modes of vibration.

The sensitivity of probe 20 also depends on the configuration of target feature 24. In particular, sensitivity depends upon the shape of circumferential face 30, and the spacing and geometrical configuration of rotational indicia 26.

Figure 3A:
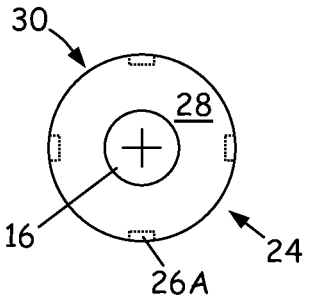
FIG. 3A is an axial view of a sensor target for the turbomachine shaft, in a circular embodiment.

FIG. 3A is an axial view of sensor target 24 for turbomachine shaft 16, in a circular embodiment. In this particular embodiment, rotational indicia 26A are formed by milling a slot or other recess into axial face 28 and circular face 30 of target feature 24, or by forming indicia 26A flush with axial face 28 and circumferential face 30, for example using a magnetic or conducting metal filler.

Figure 3B:
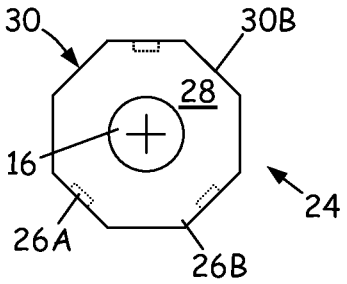
FIG. 3B is an axial view of a sensor target for the turbomachine shaft, in a polygonal embodiment.

FIG. 3B is an axial view of sensor target 24 for turbomachine shaft 16, in a polygonal embodiment. In this particular embodiment, circumferential face 30 is octagonal, with eight individual (straight and regular) sides 30B. Flush or recessed rotational indicia 26A are formed into on onto one or more sides 30B, as described above. Alternatively, protruding indicia 26B are provided, for example at the corners between sides 30B. In further embodiments, circumferential face 30 is triangular, square, pentagonal or hexagonal, and sensor target 34 has three, four, five or six sides 30B, or a different number of sides 30B.

Figure 3C:
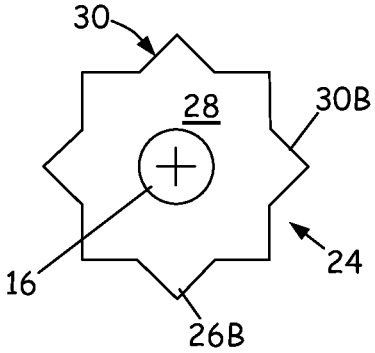
FIG. 3C is an axial view of a sensor target for the turbomachine shaft, in a lobed embodiment.

FIG. 3C is an axial view of sensor target 24 for turbomachine shaft 16, in a lobed embodiment. In this particular embodiment, protruding indicia 26B are formed as corner-shaped lobes between straight sides 30B. Depending on corner angle and the number of sides 30B, sensor target 24 is sometimes star-shaped, with indicia 26B at the points of the star.

Figure 3D:
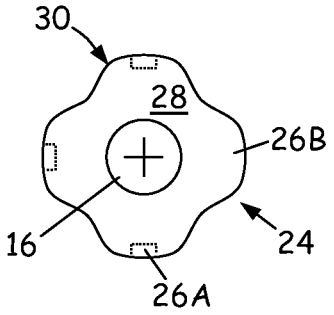
FIG. 3D is an axial view of a sensor target for the turbomachine shaft, in an alternate lobed embodiment.

FIG. 3D is an axial view of sensor target 24 for turbomachine shaft 16, in a second lobed embodiment. In this embodiment, protruding indicia 26B are formed as rounded lobes. Depending on the circumferential curvature, sensor target 24 typically has a periodic radial profile, depending on the number of lobe indicia 26B. In one particular embodiment, lobes 26B exhibit a sinusoidal variation about the average radius of circumferential face 30.

Figure 4A:
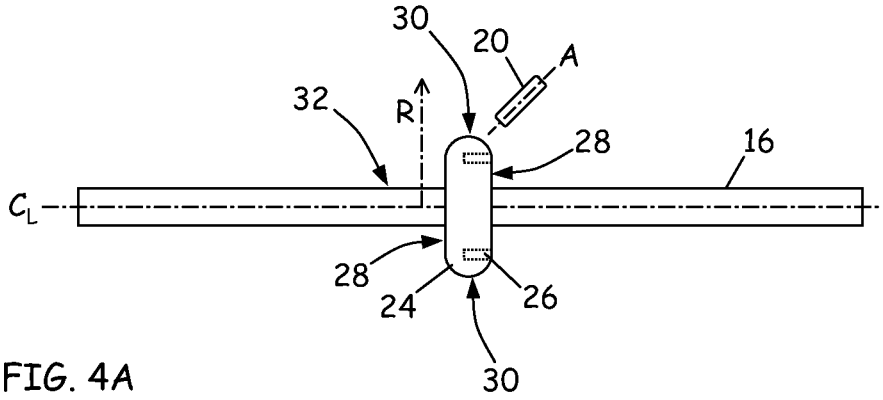
FIG. 4A is a schematic view of a turbine shaft with an axially arcuate target feature.

FIG. 4A is a schematic view of turbine shaft 16 with an axially arcuate target feature 24. In this embodiment, target feature 24 extends outward from shaft 16, away from turbine axis $C_L$, and circumferential face 30 has arcuate curvature along turbine axis $C_L$.

Axial curvature increases sensitivity to longitudinal vibrations and oscillations, because the distance between circumferential face 30 and sensor 20 depends not only on radial or transverse motion, but also on the axial position of shaft 16 and target feature 24. In particular, both the axial distance and the radial distance from target feature 24 to sensor 20 depend on the axial curvature of circumferential face 30.

Figure 4B:
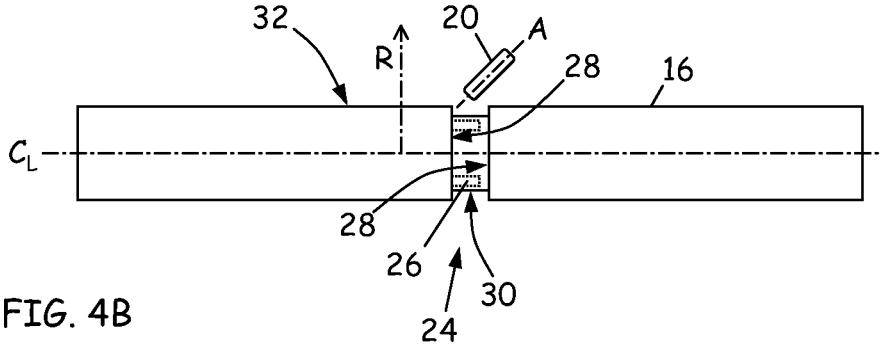
FIG. 4B is a schematic view of the turbine shaft with a recessed target feature.

FIG. 4B is a schematic view of turbine shaft 16 with a recessed target feature 24. In this embodiment, target 24 is formed as a recessed feature, extending into shaft 16 and toward turbine axis $C_L$. Radial faces 28 extend radially inward from major surface 32, and circumferential face 30 is positioned radially inward of major surface 32.

Target feature 24 extends circumferentially about shaft 16, with radial and circumferential faces 28 and 30 forming a figure of rotation about turbine axis $C_L$. The figure of rotation extends radially inward from major surface 32 of shaft 16, toward turbine axis $C_L$. Rotational indicia 26 are formed in circumferential face 30 of target feature 24, and circumferentially distributed about turbine axis $C_L$ on shaft 16.

Figure 4C:
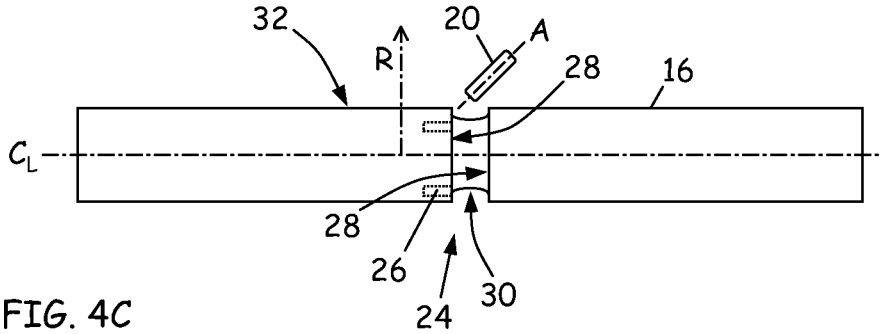
FIG. 4C is a schematic view of the turbine shaft with a recessed, axially arcuate target feature.

FIG. 4C is a schematic view of turbine shaft 16, with an arcuate, recessed target feature 24. In this embodiment, circumferential face 30 is positioned radially inward of major surface 32 of turbine shaft 16, and arcuate in the axial direction. Rotational indicia 26 are formed in major surface 32 of shaft 16, and circumferentially distributed about turbine axis $C_L$ proximate target feature 24. The curved or arcuate configuration of circumferential face 30 increases sensitivity to a combination of transverse and longitudinal oscillations, as described above with respect to FIG. 4A.

While this invention has been described with reference to exemplary embodiments, it will be understood by those skilled in the art that various changes may be made and equivalents may be substituted without departing from the essential spirit and scope thereof. In addition, modifications may be made to adapt particular situations and materials to the teachings of the invention. The invention is thus not limited to the particular embodiments disclosed herein, but includes all embodiments falling within the scope of the appended claims.

The invention claimed is:

1. A rotary apparatus comprising:

a shaft having a rotational axis;

a rotation indicator located on the shaft;

a target feature proximate the rotation indicator and extending circumferentially about the shaft, wherein the target feature has a circumferential face extending along the rotational axis and a radial face extending transversely to the rotational axis; and a sensor proximate the target feature and oriented toward the rotation indicator to sense a rotational speed of the shaft, wherein the sensor is further oriented toward the target feature to sense transverse vibrations of the shaft based on a radial distance to the target feature and longitudinal vibrations of the shaft based on an axial distance to the target feature;

wherein the circumferential face of the target feature is axially arcuate proximate the sensor.

2. The system of claim 1, wherein the target feature extends outward from a major surface of the shaft and the circumferential face is radially outward of the major surface.

3. The system of claim 1, wherein the target feature extends inward from a major surface of the shaft and the circumferential face is located radially inward of the major surface.

4. The system of claim 1, wherein the rotation indicator comprises a plurality of indicia spaced circumferentially about the rotational axis on the circumferential face of the target feature.

5. The system of claim 1, wherein the sensor is oriented at a skew angle with respect to the rotational axis, and wherein the skew angle is greater than ten degrees and less than eighty degrees.

6. The system of claim 5, wherein the skew angle is between thirty degrees and sixty degrees.

7. A turbomachine comprising:

a turbine having a rotational axis;

a shaft coupled to the turbine along the rotational axis;

a rotation indicator located on the shaft;

a target feature extending circumferentially about the shaft proximate the rotation indicator, wherein the target feature has a circumferential face extending along the rotational axis and a radial face extending transversely to the rotational axis; and a sensor proximate the target feature and oriented toward the rotation indicator to sense a rotational speed of the shaft, wherein the sensor is further oriented toward the target feature to sense transverse oscillations of the shaft based on a radial distance to the target feature and longitudinal oscillations of the shaft based on an axial distance to the target feature;

wherein the circumferential face of the target feature comprises an axially arcuate surface proximate the sensor.

8. The turbomachine of claim 7, wherein the sensor is oriented at a skew angle of greater than ten degrees and less than eighty degrees with respect to the shaft.

9. The turbomachine of claim 7, wherein the rotation indicator comprises a plurality of indicia spaced circumferentially about the circumferential face of the target feature.

10. The turbomachine of claim 9, wherein the indicia comprise a magnetic material on the circumferential face.

11. The turbomachine of claim 7, wherein the target feature extends radially outward from a major surface of the shaft.

12. The turbomachine of claim 7, wherein the target feature extends radially inward from a major surface of the shaft.

13. An air cycle machine comprising:

a turbine having a turbine axis;

a shaft rotationally coupled to the turbine along the turbine axis;

a compressor rotationally coupled to the shaft along the turbine axis;

a plurality of rotational indicia spaced circumferentially about the shaft;

a target feature extending circumferentially about the shaft proximate the plurality of rotational indicia, wherein the target feature has a radial face extending transversely to the rotational axis and a circumferential face extending along the rotational axis;

a sensor proximate the target feature and oriented toward the plurality of indicia to sense a rotational speed of the shaft, wherein the sensor is further oriented toward the target feature to sense radial vibrations of the shaft based on a radial distance from the sensor to the target feature and axial vibrations of the shaft based on an axial distance from the sensor to the target feature;

wherein the circumferential face of the target feature comprises an axially arcuate surface proximate the sensor.

14. The air cycle machine of claim 13, wherein the sensor is oriented at a skew angle of greater than ten degrees and less than eighty degrees with respect to the turbine axis.

15. The air cycle machine of claim 13, wherein the circumferential face of the target feature is recessed into a major surface of the shaft.

16. The air cycle machine of claim 13, wherein the circumferential face of the target feature extends outward from a major surface of the shaft.

* * * * *